US007584959B2

(12) United States Patent
Kinoshita et al.

(10) Patent No.: US 7,584,959 B2
(45) Date of Patent: Sep. 8, 2009

(54) MEDIA STACKER, LIQUID EJECTING APPARATUS, AND RECORDING DEVICE

(75) Inventors: Masaaski Kinoshita, Matsumoto (JP); Atsushi Sumii, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 158 days.

(21) Appl. No.: 11/561,831

(22) Filed: Nov. 20, 2006

(65) Prior Publication Data

US 2007/0114714 A1 May 24, 2007

(30) Foreign Application Priority Data

Nov. 21, 2005 (JP) ..... 2005-335886
Oct. 18, 2006 (JP) ..... 2006-284390

(51) Int. Cl.
*B65H 31/04* (2006.01)

(52) U.S. Cl. ..... 271/214; 271/207; 271/213; 271/215; 271/217; 271/163; 347/104; 400/646; 400/647

(58) Field of Classification Search ..... 271/207, 271/213, 214, 215, 217, 163; 347/104; 400/646, 400/647

See application file for complete search history.

(56) References Cited

U.S. PATENT DOCUMENTS 4,718,657 A * 1/1988 Otter et al. ..... 271/184
4,854,570 A * 8/1989 Martin et al. ..... 271/162
5,111,252 A * 5/1992 Hamada et al. ..... 399/393
5,251,890 A * 10/1993 Sasai ..... 271/176
5,297,923 A * 3/1994 Boriani et al. ..... 414/795.4
5,318,401 A * 6/1994 Mandel ..... 414/792.7
5,384,624 A * 1/1995 Kajiwara ..... 399/23
5,559,606 A * 9/1996 Webster et al. ..... 358/296
5,597,152 A * 1/1997 Chinzei ..... 270/39.05
5,743,518 A * 4/1998 Takashimizu et al. ..... 271/4.1
5,897,110 A * 4/1999 Fujiwara ..... 271/4.01
6,283,470 B1 * 9/2001 Hirai ..... 271/189
6,428,000 B1 * 8/2002 Hara et al. ..... 271/223
6,616,140 B2 * 9/2003 Siegenthaler ..... 271/213
6,729,616 B2 * 5/2004 Chen ..... 271/213
7,251,451 B2 * 7/2007 Takagi et al. ..... 399/405
7,441,771 B2 * 10/2008 Tamura et al. ..... 271/207
2004/0036756 A1 * 2/2004 Nakano et al. ..... 347/104
2005/0052518 A1 * 3/2005 Kagami ..... 347/104
2005/0162494 A1 * 7/2005 Inokuchi et al. ..... 347/104
2006/0181590 A1 * 8/2006 Nonaka ..... 347/104
2007/0002116 A1 * 1/2007 Budelsky et al. ..... 347/104

(Continued)

FOREIGN PATENT DOCUMENTS

JP 05330717 A * 12/1993

(Continued)

*Primary Examiner*—Patrick H Mackey
*Assistant Examiner*—Prasad V Gokhale
(74) *Attorney, Agent, or Firm*—Workman Nydegger

(57) ABSTRACT

A media stacker which can be inserted into a main body of a liquid ejecting apparatus and stack a discharged recording medium moves downward in an inclined direction to be located below a liquid ejecting portion and a discharge portion when the media stacker is being inserted and moves upward in the inclined direction to be located vicinity to a discharge slot when the media stacker is being extracted. A guide mechanism for guiding movement of the media stacker and a guide gear which is rotated while following to the guide mechanism are formed on both sides of the media stacker.

7 Claims, 16 Drawing Sheets

U.S. PATENT DOCUMENTS

2008/0111875 A1 * 5/2008 Nagashima et al. ..... 347/104

FOREIGN PATENT DOCUMENTS

JP 06127789 A * 5/1994
JP 06171815 A * 6/1994
JP 2003-073007 3/2003
JP 2004-059174 2/2004
JP 2004-075264 3/2004
JP 2005-053592 3/2005
JP 2005-112556 4/2005

* cited by examiner

MEDIA STACKER, LIQUID EJECTING APPARATUS, AND RECORDING DEVICE

BACKGROUND

1. Technical Field

The present invention relates to a media stacker capable of being inserted into a main body of a liquid ejecting apparatus and stacking an ejected recording medium, a liquid ejecting apparatus, and a recording device including the media stacker.

2. Related Art

Generally, in an ink jet type printer which is an example of a recording device, end portions of new recording media are lifted up by a hopper while being supported by a paper support which is disposed on a rear side of a main body of the printer, and an uppermost recording medium is drawn out by a feed roller and fed. The fed recording medium is transported by a transport roller to be recorded on, and, after information is recorded thereon, the recording medium is discharged by a discharge roller to be discharged into a stacker which is disposed on a front side of the main body of the printer (see JP-A-2003-73007).

Since the stacker is required to stack various sizes of recording media in a limited space, the stacker has a multi-level structure having three or more levels which can be inserted and extracted. As the position of a stacker portion of the stacker having the multi-level structure becomes higher, a support width of the stacker portion is reduced. Accordingly, when a recording medium having a relatively big size such as a JIS A2 size is discharged, an end portion of the recording medium, especially both sides of the end portion, may be protruded off the stacker to be bent.

On the other hand, a stacker which can be inserted into or extracted from a main body of a printer by being slid approximately parallel to a bottom surface of the main body of the printer has been proposed (see JP-A-2004-75264 and JP-A-200-59174). When the stacker having this structure is used, a stacking area can be formed to be large to make it possible to stack a relatively large recording medium stably. In order to slide the stacker substantially parallel to the bottom surface of the main body of the printer, a guide mechanism is required.

The guide mechanism may include guide pins and guide grooves, as an example. Two guide pins are installed with a predetermined distance therebetween so as to protrude on each side of a discharge stacker. One guide groove is formed on each one of side frames which are located on both sides of the stacker in the main body of the printer. The guide mechanism having this structure guides sliding of the stacker by causing the guide pins to slide along the guide grooves. However, since the guide pins slide along the same guide groove, twisting occurs between the guide groove and the guide pins to deteriorate the operability of the guide mechanism when a force is unevenly applied to the guide pins. The twisting easily occurs especially when the stacker is slid at a sharp angle between the insertion position and the extraction position without greatly changing an angle of the stacker.

SUMMARY

An advantage of some aspects of the invention is that it provides a media stacker capable of stably stacking a discharged recording medium including a relatively large size medium and being easily inserted into and extracted from a main body of a liquid ejecting apparatus, the liquid ejecting apparatus including the media stacker, and a recording device including the media stacker.

According to an aspect of the invention, a media stacker which can be inserted into a main body of a liquid ejecting apparatus and stack a discharged recording medium moves downward in an inclined direction to be located below a liquid ejecting portion and a discharge portion when the media stacker is being inserted and moves upward in the inclined direction to be located vicinity to a discharge slot when the media stacker is being extracted. In addition, a guide mechanism for guiding movement of the media stacker and a guide gear which is rotated while following to the guide mechanism are formed on both sides of the media stacker. Accordingly, a large space can be provided below the liquid ejecting portion and the discharge portion. Therefore, even when the media stacker does not have a multi-level structure, the media stacker can stack relatively large media and can stably stack the media. In addition, the media stacker can be smoothly inserted into and extracted from the main body of the liquid ejecting apparatus.

The guide mechanism may include a guide pin which is formed in a main body of the media stacker and a guide groove which is formed on the main body of the liquid ejecting apparatus and extends in insertion/extraction directions and inclined upward/downward directions. In addition, the guide gear may include a pinion gear which is formed on the main body of the media stacker and a rack gear which is formed on the main body of the liquid ejecting apparatus and extends in the insertion/extraction directions and the inclined upward/downward directions. Accordingly, a mechanism for guiding the media stacker can be easily obtained. Two sets of the guide mechanisms may be disposed to be displaced from each other in the insertion/extraction direction and in the upward/downward directions. Accordingly, the media stacker can be smoothly inserted and extracted.

The media stacker may further include a first stacker portion in which the guide mechanisms are formed; a second stacker portion which can be inserted into or extracted from the first stacker portion; and an operation regulation mechanism which regulates operations, so that the second stacker portion is not extracted when the first stacker portion is being extracted and the first stacker portion is not inserted when the second stacker portion is being inserted. Accordingly, the second stacker portion can be extracted after the first stacker portion is extracted, and the first stacker portion can be inserted after the second stacker portion is inserted. As a result, twisting between the stackers can be prevented and the media stacker can be smoothly inserted and extracted.

The operation regulation mechanism may include a first regulation mechanism for regulating an operation of insertion of the first stacker portion in an extracted state, a second regulation mechanism for regulating an operation of extracting the second stacker portion in an inserted state, and a third regulation mechanism for regulating an operation of insertion of the second stacker portion in an extracted state. The first operation regulation portion may include a recessed portion which is formed on a main body of the liquid ejecting apparatus and a projecting portion which is formed in a rear side of the first stacker portion and can be inserted into the recessed portion. The second operation regulation portion may include a first locking protrusion which is formed in the rear side of the first stacker portion and a protrusion to be locked which can be locked by the first locking protrusion. The third operation regulation portion may include a second locking protrusion which is formed in a front side of the first stacker portion and can lock the protrusion to be locked. Accordingly, the operation regulating mechanism can be easily structured.

According to another aspect of the invention, a liquid ejecting apparatus for ejecting liquids onto a medium includes the above-described media stacker. In addition, according to another aspect of the invention, recording device for recording information on a recording medium includes the above-described liquid ejecting apparatus according. Thus, a liquid ejecting apparatus and a recording device that provide the above-described advantages are provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described below with reference to the accompanying drawings. It is to be noted that the following embodiments do not limit the scope of the invention, and not all of the combinations of the characteristics described in the embodiments are essential to solve the problems to be solved by the invention.

Figure 1:
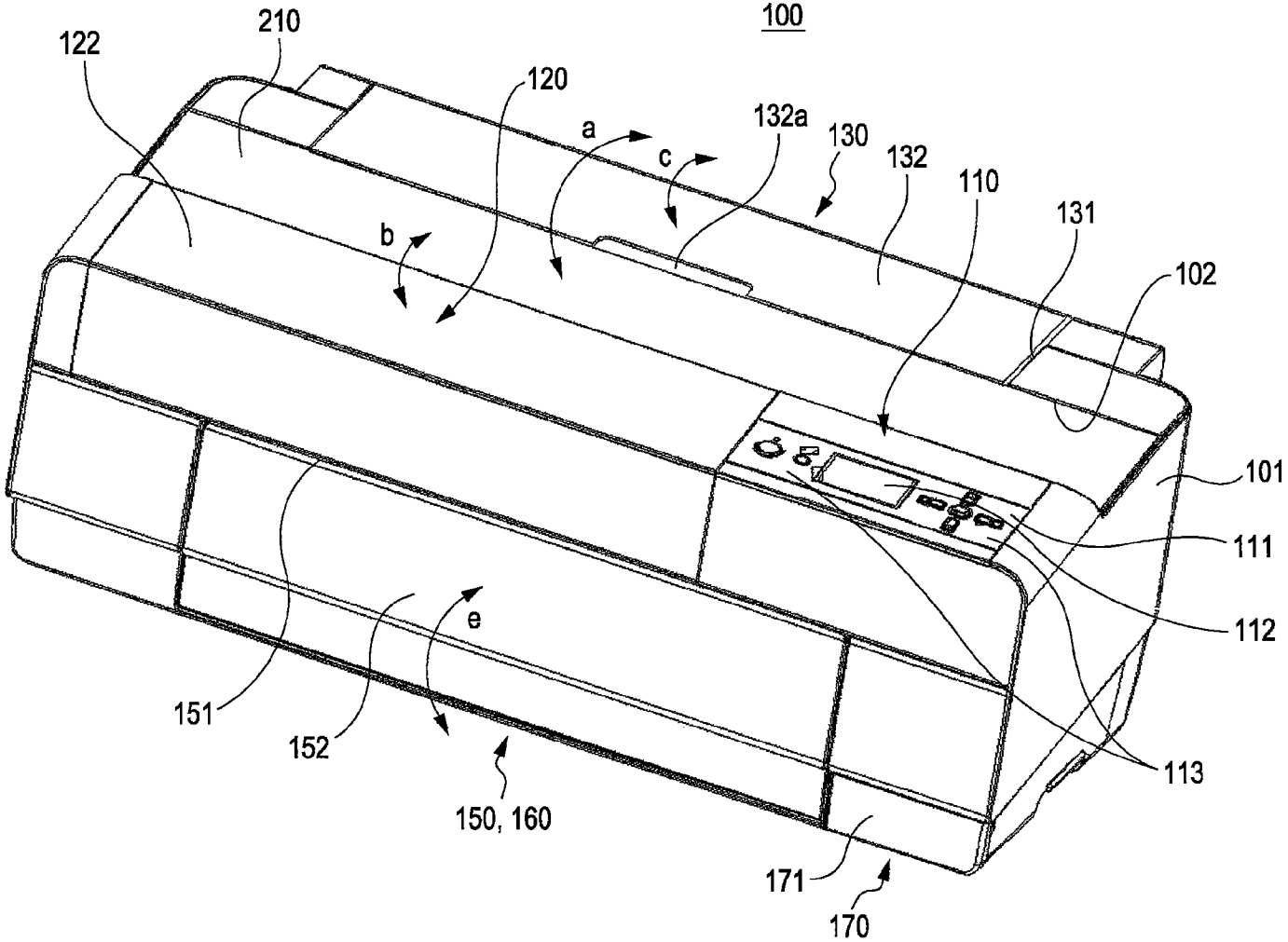
FIG. 1 is a perspective view showing a whole exterior of an ink jet type printer as viewed from a front side of the inclination as a recording device according to an exemplary embodiment of the invention.
Figure 2:
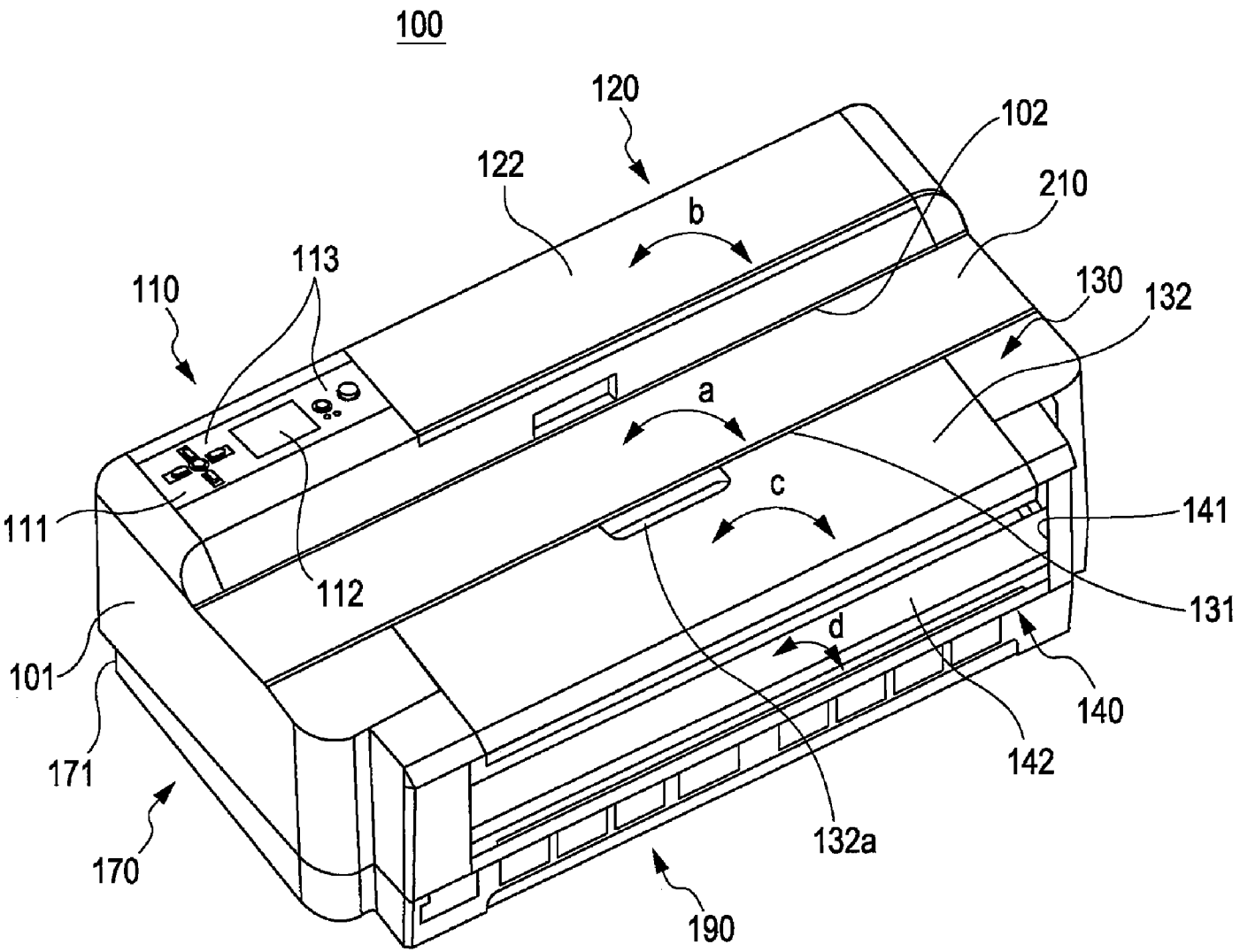
FIG. 2 is a perspective view of the printer in FIG. 1 as viewed from a rear side of the inclination.
Figure 3:
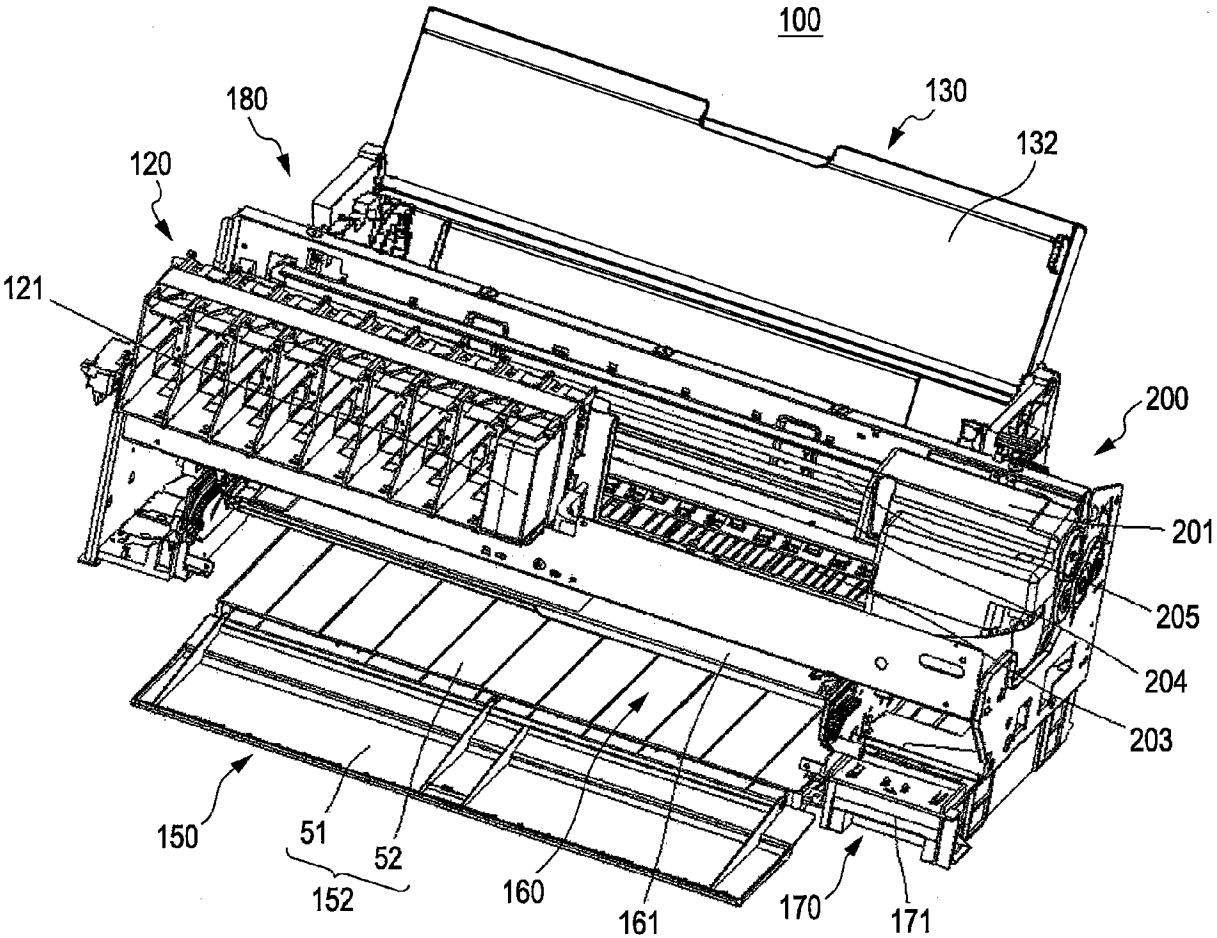
FIG. 3 is a perspective view showing a schematic internal structure of the printer in FIG. 1.
Figure 4:
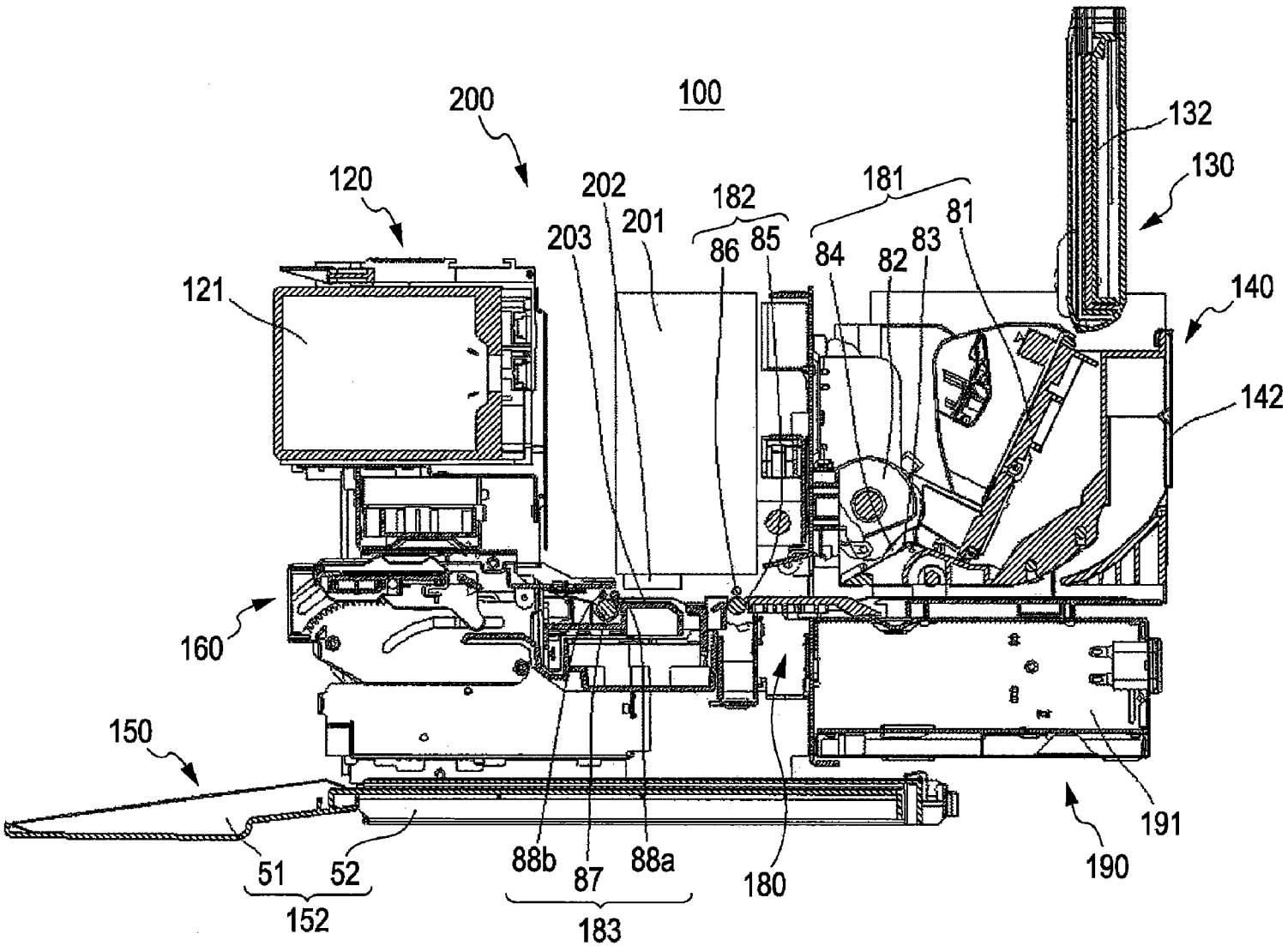
FIG. 4 is a first side cross-sectional view showing a schematic internal structure of the printer in FIG. 1.
Figure 5:
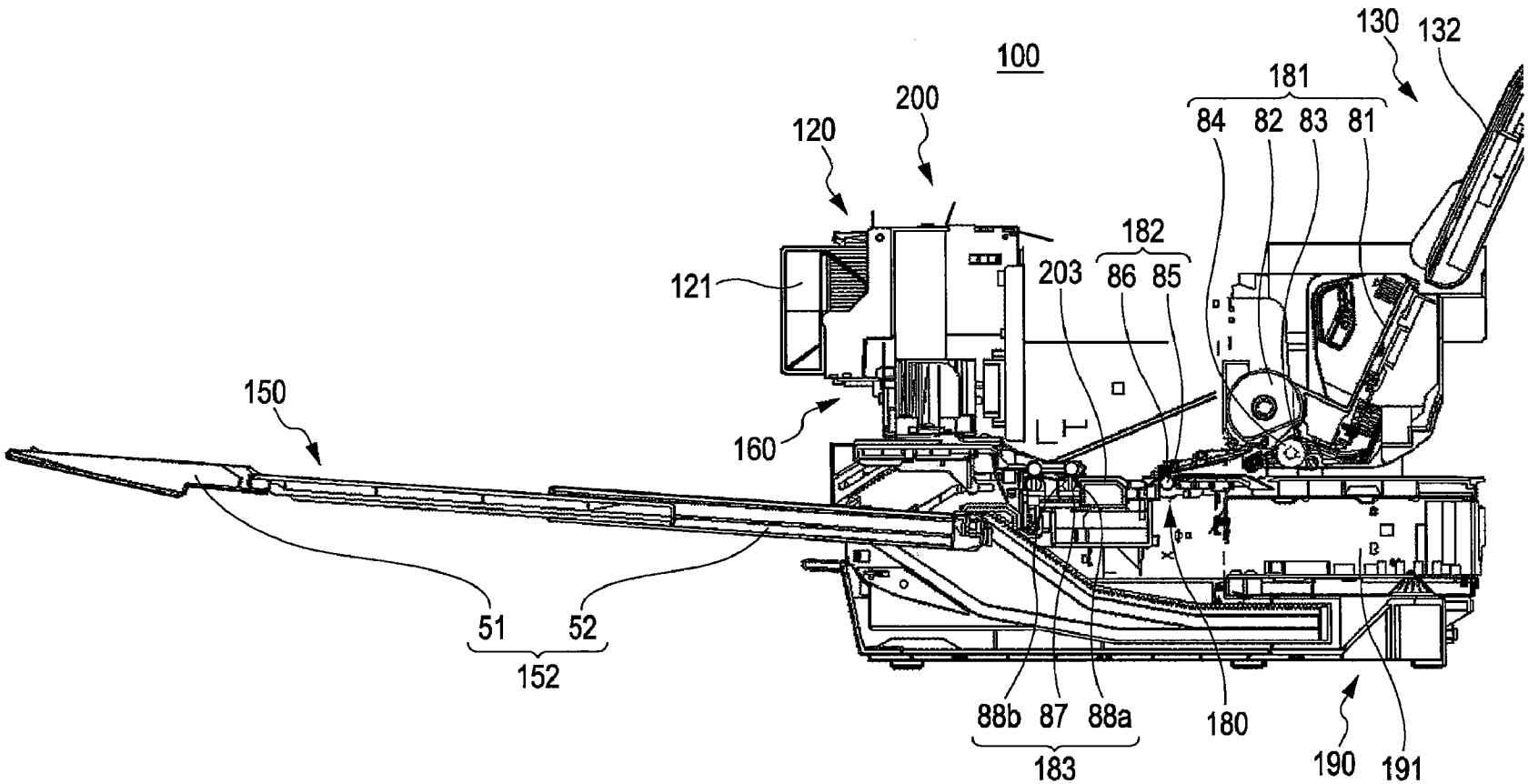
FIG. 5 is a second cross-sectional side view showing a schematic internal structure of the printer in FIG. 1.

FIGS. 1 and 2 are perspective views of an ink jet type printer which is an example of a recording device according to an embodiment of the invention as viewed from front and rear sides, respectively. FIG. 3 is a schematic perspective view of the ink jet printer illustrating an internal structure of the ink jet type printer. FIGS. 4 and 5 are schematic side cross-sectional views of the ink jet type printer showing the internal structure thereof. The ink jet type printer 100 has a function for recording information on a single sheet of paper (hereinafter, referred to as recording medium) of L, 2L, postcard, JIS A4, JIS A3 Nobi, JIS A2 sizes with ink (liquid).

As illustrated in FIGS. 1 and 2, a housing 101 which has an substantially rectangular parallelepiped shape constitutes an outer surface of the ink jet type printer 100. On a front right side of a top side of the housing 101, as shown in FIG. 1, an operation portion 100 is disposed, and on a front left side of the top side of the housing 101, as shown in FIG. 1, a cartridge receiving portion 120 is disposed. On a rear side of the front side of the housing 101 shown in FIG. 1, a first rear feed portion 130 is disposed, and on a rear side of the housing 101 shown in FIG. 2, a second rear feed portion 140 is disposed. On the front side of the housing 101 shown in FIG. 1, a discharge portion (ejection portion) 150 including a characteristic portion of the invention and a front feed portion 160 are disposed, and on a front right side of the housing 101 shown in FIG. 1, a waste ink collector 170 is disposed. Inside the ink jet type printer 100, a transport portion 180 shown in FIGS. 3 and 4, a controller 190 shown in FIGS. 2, 4, and 5, and a recording portion 200 (liquid ejecting portion) shown in FIGS. 3, 4, and 5 are disposed.

As shown in FIGS. 1 and 2, between the operation and cartridge receiving portions 110 and 120 and the first rear feed portion 130, an opening portion 102 is formed. The opening portion 102 is covered with an approximately flat rectangular printer cover 210. The printer cover 210 is attached so as to be able to pivot around a pivoting shaft on the rear side thereof in a direction of an arrow a. A user can easily perform operations including maintenance of internal mechanisms such as the transport portion 180 and the recording portion 200 through the opening portion 102 by lifting the printer cover 210 up to open the opening portion 102.

The operation portion 110, as shown in FIGS. 1 and 2, includes an substantially rectangular control panel 111, and in the approximate center of the control panel 111, a liquid crystal panel 112 for displaying an operational status or the like is disposed. On both sides of the liquid crystal panel 112, buttons 113 including a power button for turning the power on/off, an operational button for cueing of a recording medium or for flushing the ink, and a process button for instructing processing of an image are disposed. The user can operate the buttons 113 while monitoring information displayed on the liquid crystal panel 112, and accordingly an erroneous operation of the user can be prevented.

The cartridge receiving portion 120, as shown in FIGS. 1 and 2, stores a predetermined number of color inks, which is nine in the example, for printing and is installed so that the ink cartridge 121, shown in FIGS. 3, 4, and 5 can be inserted into or extracted from the cartridge receiving portion 120. The cartridge receiving portion 120 is covered with a cartridge cover 122 having an "L" shaped cross section. The cartridge cover 122 is attached so as to be able to pivot around a pivoting shaft on the rear side thereof in a direction of an arrow b. The user can easily perform operations including replacing the ink cartridge 121 by lifting the cartridge cover 122 to open the cartridge receiving portion 120, and accordingly the efficiency of the operations can be improved.

The first rear feed portion 130 is for automatic sheet feeding (ASF). As shown in FIGS. 1 and 2, the first rear feed portion 130 includes a first paper support 132 of a four level structure which has functions for opening/closing a first pickup slot 131 and supporting one recording medium or multiple recording media to be fed. The first paper support 132 is attached so as to be able to pivot around the pivoting shaft on the rear side in a direction of an arrow c. The relatively thin recording medium, for example, a recording medium of a regular or photo paper having a depth of 0.08 mm to 0.27 mm is used for the paper to be fed from the first rear feed portion 130.

Before using the ink jet type printer 100, the user inserts his finger into a hole 132*a* which is formed in a front center of the first paper support 132, lifts the first paper support 132 up, and extracts a multi-level portion to complete setting of the ink jet type printer 100. Accordingly, operations for storage, management, and the like which are required for an attachable/detachable paper support are needless. Since the structure of the first paper support 132 is multi-levels, the ink jet type printer can support for feeding recording media having various sizes effectively. In addition, by pushing the multi-level portion of the first paper support 132 the first paper support 132 can be closed to block the first pickup slot 131 after the ink jet type printer 100 is used, and accordingly penetration of dusts into the main body of the printer can be prevented, and the first paper support 132 can be stored compactly.

A second rear feed portion 140 is for manual feeding. The second rear feed portion 140 includes a second paper support 142 of a two level structure having functions for opening/closing a second pickup slot 141 of which open shape is rectangular toward the rear side and supporting one recording medium to be fed. The second paper support 142 is attached to be able to pivot around the pivoting shaft on the rear side in a direction of an arrow d. As a recording medium which is fed from the second rear feed portion 140, a recording medium which has a depth which cannot be fed with a transport angle of the first rear feed portion 130, for example, a recording medium including drawing paper or ink jet paper having a width of about 0.29 mm to 0.48 mm is used. Since the first rear feed portion 130 is used for automatic sheet feeding (ASF), the first rear feed portion 130 picks up a recording medium into the feed roller. Accordingly, when paper dusts are attached to the feed roller 82, and the dusts are accumulated, slip may occur to generate a feed fault. For this reason, a type of paper which can easily generate paper dusts, for example, velvet fine art paper having a depth of about 0.48 mm or ultra smooth fine art paper having a depth of about 0.46 mm, needs to be manually fed into the second rear feed portion 140.

Before using the ink jet type printer 100, the user hangs his finger on an upper portion of the second paper support, pushes the second paper support down, and extracts the multi-level portion to complete setting of the ink jet type printer 100. Accordingly, operations for storage, management, and the like which are required for an attachable/detachable paper support are needless. Since the structure of the second paper support 142 is multi-levels, the ink jet type printer can support feeding recording media having various sizes effectively. In addition, since the multi-level portion of the first paper support 132 can be pushed to be closed for blocking the second pickup slot 141 after the ink jet type printer 100 is used, penetration of dusts into the main body of the printer can be prevented, and the second paper support 142 can be stored compactly.

The discharge portion 150, as shown in FIG. 1, includes a two level stacker (media stacker) which includes first and second stackers 51 and 52 shown in FIGS. 3, 4, and 5 and has both functions for opening/closing a second discharge slot 151 (ejecting slot) having a rectangular shape open toward a front side and stacking one or multiple sheets of discharged paper. The first stacker 51 is attached to be able to pivot about a pivoting shaft at an front end of the second stacker 52 in a direction of an arrow e shown in FIG. 1. The second stacker 52 is attached to be able to be inserted or extracted by parallel moving upward or downward in the inclination of the discharge slot 151. The stacker 152 which is an aspect of the invention will be described later in more details.

The front feed portion 160 is used for manual feeding. As shown in FIG. 3, the front feed portion 160 includes a feed tray 161 which is disposed at the discharge slot 151 above the stacker 152. The paper feed tray 161 is formed to be able to move parallel to the paper discharge slot 151. A relatively thick recording medium, for example, a mat board paper having a thickness of approximately 1.2 mm which cannot be bent in transporting is used as a recording medium to be fed into the front feed portion 160.

Before using the ink jet type printer 100, when the user softly pushes a front end of the feed tray 161 to pull out a stopper of the feed tray 161, the feed tray 161 becomes protruded from the discharge slot 151. In addition, after using the ink jet type printer 100, when the user softly pushes the front end of the feed tray 161, the stopper of the feed tray is locked, and accordingly the feed tray 161 is inserted into the discharge slot 151. Accordingly, the space efficiency of disposition of the feed tray 161 can be increased.

As illustrated in FIGS. 1 to 3, the waste ink collector 170 is constructed in such a way that a waste ink tank 171 for storing waste ink and the like can be inserted or extracted. The waste ink collector 171 stores waste ink which is wasted at a time when the recording head 202 is cleaned, an ink cartridge is replaced, or the like. When the waste ink tank 171 is full of the waste ink and the like, the user can easily perform replacing the waste ink tank 5171 by only extracting the waste ink tank 171 and inserting a new waste ink tank 171.

As shown in FIGS. 3, 4, and 5, the transport portion 180 is disposed from the first and second feed portions 130 and 140 to the discharge portion 150. The transport portion 180 includes an automatic sheet feed mechanism 181, a transport mechanism 182, and a paper discharge mechanism 183. As shown in FIG. 4, the automatic sheet feed mechanism 181 includes a hopper 81 for lifting up supported sheets of recording paper for feeding, a feed roller for taking out sheets lifted by the hopper 81, a retard roller for separating one sheet among the overlaid sheets of paper fed by the feed roller 82, and a paper return lever 84 for returning the remaining sheets after separation by the retard roller 83 to the hopper 81 of separated for return roller.

The hopper 81 is formed to have a flat-shape on which a sheet can be placed and disposed substantially parallel to a rear wall. A bottom end of the hopper 81 is located in proximity of the feed roller 82, and a top end of the hopper 81 is in proximity of a top portion of the rear wall. To the other side of bottom end of the hopper 81, an outer end of a pressing spring of which one end is attached to a rear wall is attached, and the bottom end side is disposed in such a way that the bottom end turns around the top end side by expansion and contraction of the compression spring.

The feed roller 82 of which a partial cross section is formed in a shape of a cutout letter "D" is disposed in the proximity of a lower end of the hopper 81. The feed roller 82 rotates intermittently to feed by friction the recording medium which is lifted by the hopper 81. The retard roller 83 is disposed to be able to contact the feed roller 82. The retard roller 83 separates only an upper most sheet from lower sheets by friction when overlaid sheets are sent by the feed roller 82. The paper return lever 81 is formed in a shape of a hook and disposed in the proximity of the feed roller 82. The paper return lever 81 hooks and returns the lower recording media which are separated by the retard roller 83 to the hopper 81.

In the transport mechanism 182, as shown in FIGS. 4 and 5, a transport roller 85 which transfers a recording medium in a sub ejection direction in synchronization with a recording operation and a driven roller 81 which is driven by the transport roller 85 are included. The transport roller 85 is disposed on a feed upstream side of a platen 203. The transport roller 85 pinches the recording medium fed by the feed roller 82 together with the driven roller 86 to be sent out to the platen 203.

The paper discharge mechanism 183, as shown in FIGS. 4 and 5, includes a discharge roller 87, a first saw-toothed roller 88*a* and a second saw-toothed roller 88*b*. The first saw-toothed roller 88*a* is disposed on a transport down stream side of a platen 203. The second saw-toothed roller 88*b* and the discharge roller 77 is disposed to face the transport down stream side of the first saw-toothed roller 88*a*. A recording medium which passes the platen 203 is firstly discharged to the first saw-toothed roller 88*a* and then, continuously pinched by the second saw-toothed roller 88*b* and the discharge roller 87 to be arranged on the stacker 152. The first saw-toothed roller 88*a* and the second saw-toothed roller 88*b* are supported by a same supporting member which is not shown in the figures.

The control portion 190, as shown in FIGS. 4 and 5, includes a main substrate 191 constructing a printer controller. On the main substrate 191, control components, memory components, and other various circuit components including CPU, ROM, RAM, ASIC which are not shown in the figures are disposed. The control portion 190 controls the transport portion 180, the recording portion 200, and the like which construct a print engine.

In the recording portion 200, as shown in FIGS. 4 and 5, a carriage 201 which moves in a main ejecting direction in synchronization with the recording operation, a recording head 202 which ejects ink in synchronization with the recording operation, a platen 203 which maintains a sheet smoothly in printing are included. The carriage 201, as shown in FIG. 3, is disposed to perforate into a carriage guide shaft 204 above the platen 203 and connected to a carriage belt 205. When a carriage belt 205 is operated by a carriage motor which is not shown in the figures, the carriage 201 is pulled in by a movement of the carriage belt 205 and guided to the carriage guide shaft 204 to reciprocate.

The recording head 202, as shown in FIGS. 4 and 5, is mounted on the carriage 201 while being spaced apart from the platen 203 by a predetermined distance. The recording head 202 can eject each one of two kinds of black ink, for example, photo black and mat black ink, and seven colors of ink including yellow, cyan, light cyan, magenta, light magenta, grey, and red ink. In other words, in the recording head 202, a pressure generation room and an open nozzle hole connected thereto are formed on a nozzle plate, and an ink drop having a controlled size is to be ejected from the open nozzle hole toward a sheet by storing ink in the pressure generation room and pressing the stored ink at a predetermined pressure. The platen 203 which is disposed between the feed roller 85 and the discharge roller 87 is disposed to face the recording head 202. The platen 203 supports a sheet which is transported. Next, the stacker 152 which is an aspect of the invention will be described in more details with reference to figures.

Figure 6:
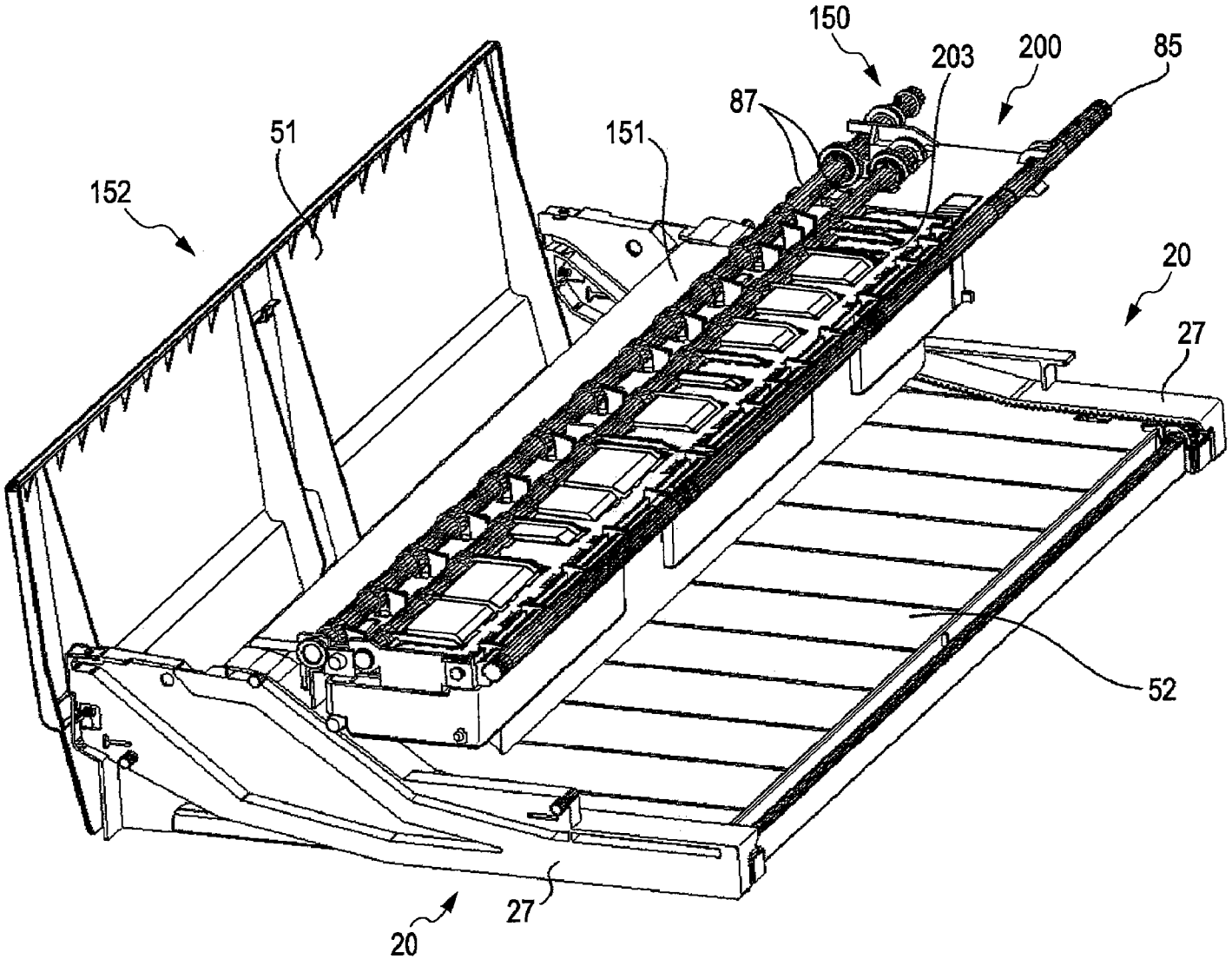
FIG. 6 is a perspective view showing an insertion status of a stacker of the printer in FIG. 1 as viewed from an upstream side of a feed direction.
Figure 7:
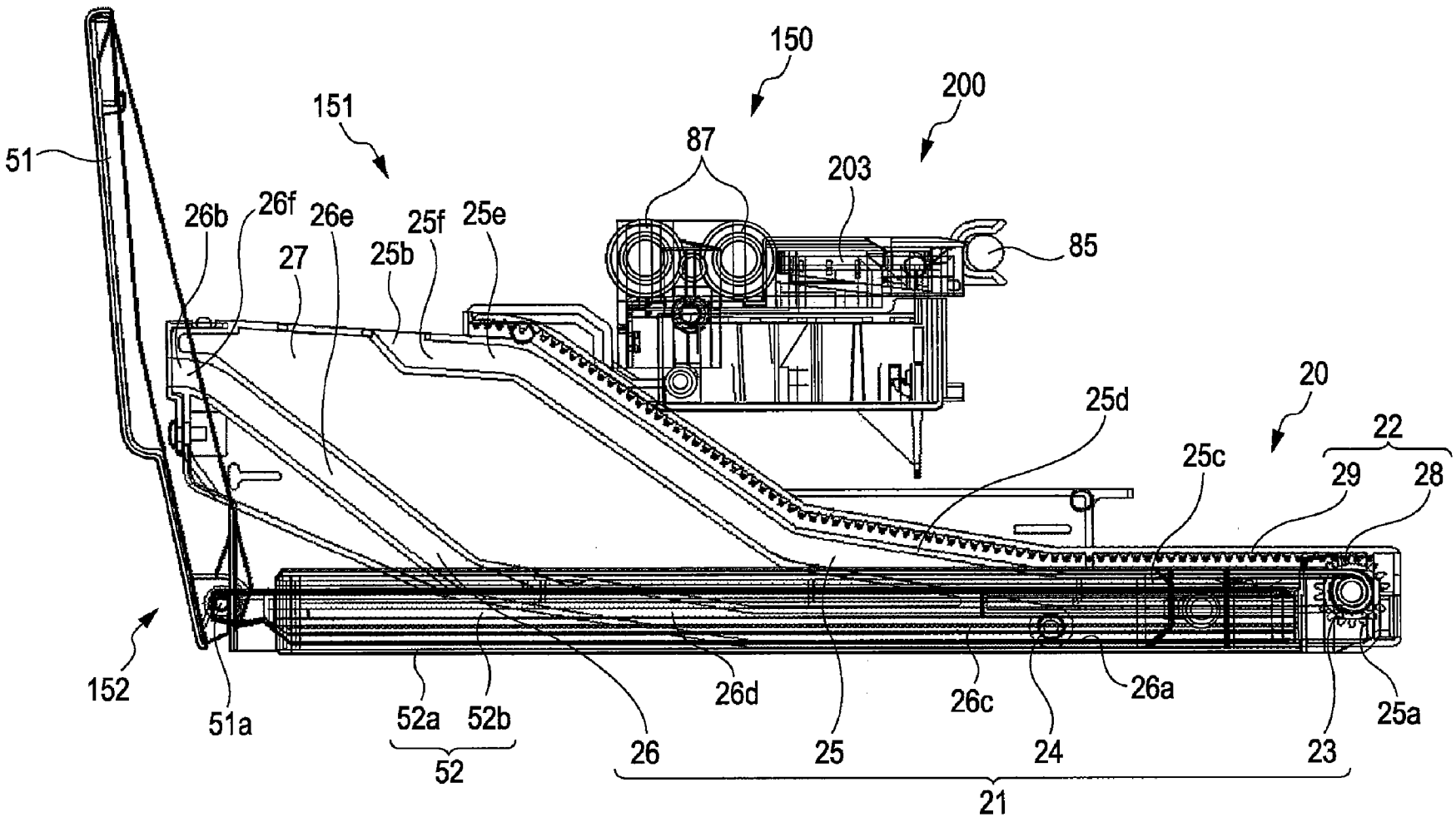
FIG. 7 is a side view of FIG. 6.
Figure 8:
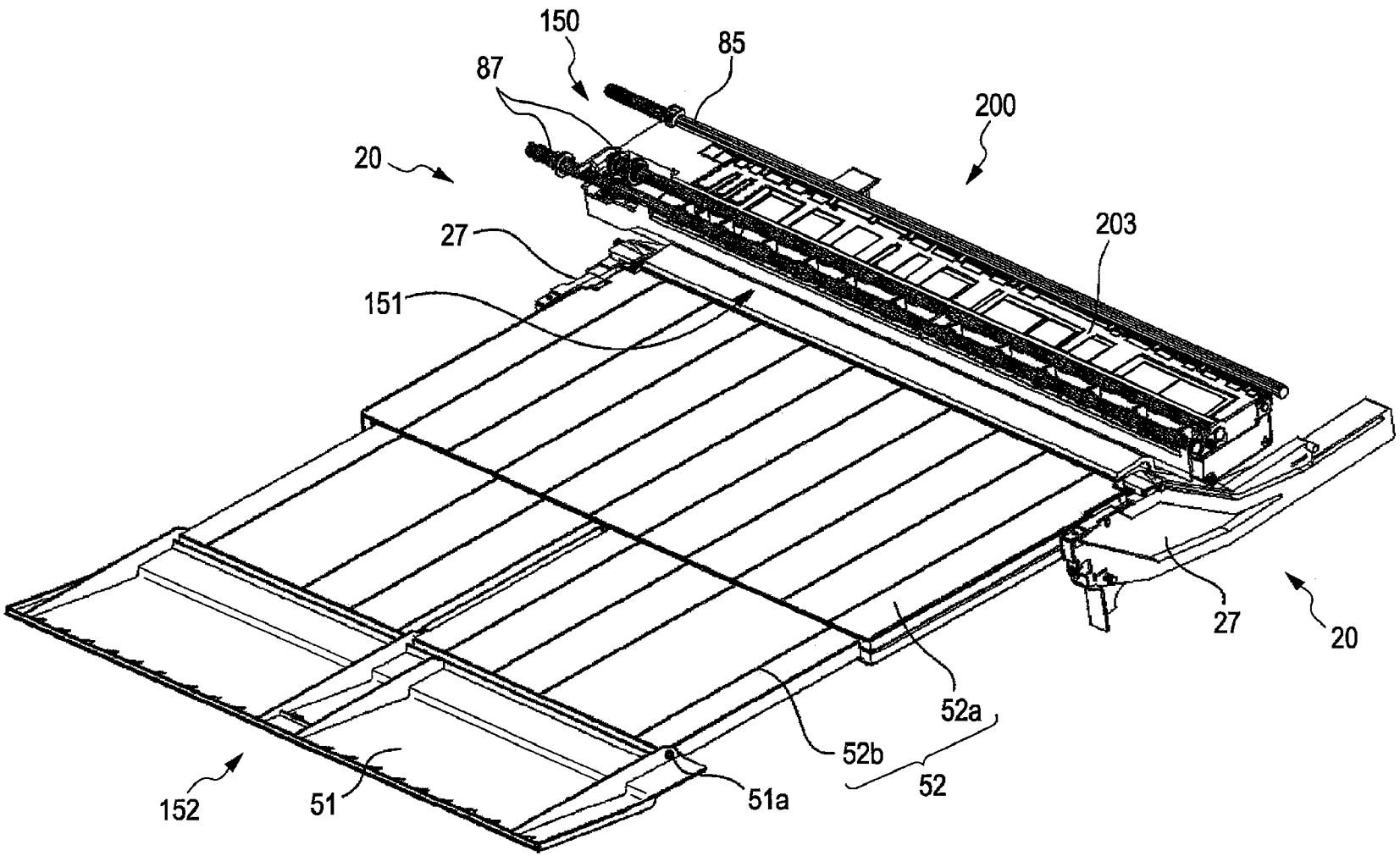
FIG. 8 is a perspective view showing a protruded status of a stacker of the printer in FIG. 1 as viewed from a downstream side of a feed direction.
Figure 9:
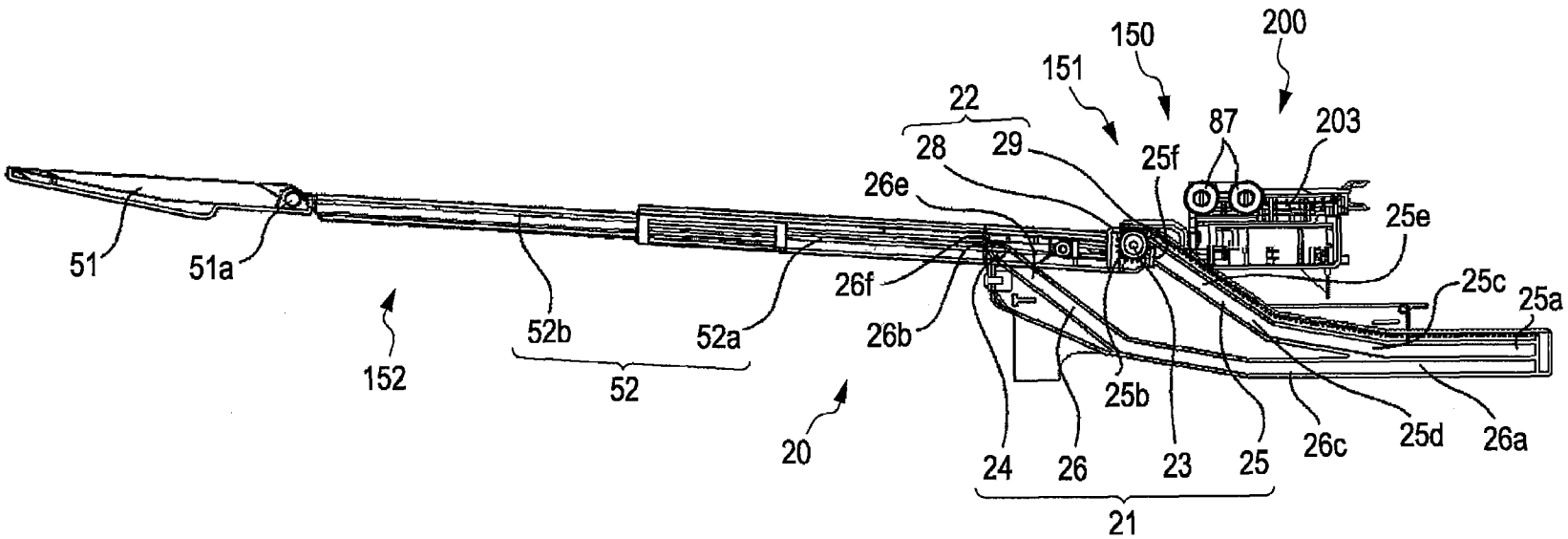
FIG. 9 is a side view of FIG. 8.

FIG. 6 is a perspective view from an upstream side of a discharge direction showing an inserted status of the stacker, and FIG. 7 is a side view thereof. FIG. 8 is a perspective view from a downstream side of a discharge direction showing an extracted status of the stacker, and FIG. 9 is a side view thereof. The stacker 152 has a two level structure including a first stacker 51 and a second stacker (stacker main body) 52. The first stacker 51 is The first stacker 51 is attached to be able to pivot about a pivoting shaft at an end side of the second stacker 52. The second stacker 52. The second stacker 52 is attached to be able to be inserted or extracted by parallel moving upward or downward in the inclination of the discharge slot 151.

The first stacker 51 pivots between a status being disposed substantially vertical to the second stacker 52 at the front end of the second stacker 52 shown in FIGS. 6 and 7 and a status being disposed substantially horizontal to the second stacker 52 shown in FIGS. 8 and 9. In other words, as shown in FIGS. 6 and 7, in the status in which the second stacker 52 is inserted, the first stacker 51 is disposed substantially vertical to the second stacker 52 to close the discharge slot 151. On the other hand, as shown in FIGS. 8 and 9, in a status in which the second stacker 52 is extracted, the first stacker 51 is disposed substantially vertical to the second stacker 52 to open the discharge slot 151.

The second stacker 52 moves parallel upward and downward together with the first stacker 51 in the inclination between a insertion position in the printer main body which is located inside with respect to the discharge slot 151 shown in FIGS. 6 and 7 and an extracted position outside the printer main body which is located at a front side with respect to the discharge slot 151 shown in FIGS. 8 and 9. In other words, as shown in FIGS. 6 and 7, in the insertion position, the second stacker 52 moves downward in the inclination to be located below the recording portion 200 and the discharge portion 150. On the other hand, as shown in FIGS. 8 and 9, in an extracted position, the second stacker moves upward in the inclination to dispose a rear end close to the discharge slot 151.

As shown in FIGS. 8 and 9, the second stacker 52 has a two level structure including a first stacker portion 52*a* and a second stacker portion 52*b*. The first stacker portion 52*a* is formed in a shape of a hollow flat plate. The second stacker portion 52*b* is formed in shape of a flat plate having the width slightly smaller than that of the first stacker portion 52*a*. The second stacker portion 52*b* is disposed to be able to slide horizontally inside the first stacker portion 52*a*.

Accordingly, the second stacker portion 52*b* can be inserted into or extracted from the first stacker portion 52*a*. The second stacker 52 is used in the status in which the second stacker portion 52*b* is inserted into the first stacker portion 52*a* when a size of the discharged recording medium is small. On the other hand, the second stacker 52 is used in the status in which the second stacker portion 52*b* is extracted from the first stacker portion 52*a* when the size of the discharged recording medium is large. Since the second stacker 52 has a two level structure, a case where the support width becomes extremely small never happens as in a case where general stackers having three or more level structures are used.

A guiding mechanism 20, as shown in FIGS. 7 and 9, includes a guide cam (guide means) 21 and a guide gear 22, which are disposed on both sides of the second stacker 52, respectively. The guide mechanism 20 guides parallel movement of the stacker 152 upward or downward the inclination smoothly. The guide cam 21 includes two guide pins 23 and 24 and two guide grooves into which the guide pins 23 and 24 are inserted, respectively, which are disposed on both sides of the second stacker 52.

The guide pins 23 and 24 are disposed to be discrepant upward and downward in the insertion and extraction direction in rear positions on a side of the first stacker portion 52*a* of the second stacker 52. In other words, the guide pin 23 is disposed to be protruded vicinity to a rear portion on the side of the first stacker portion 52*a*, and the guide pin 24 is exposed to be extruded on the side of the first stacker portion 52*a* at a position which is lower than the guide pin 23 by a predetermined distance and is located in front of the guide pin 23 with a predetermined distance apart.

The guide grooves 25 and 26 are formed on a guide forming member 27 which is disposed along the both side portions of the first stacker portion 52*a*. The guide grooves 25 and 26 are formed to connect first end portions 25*a* and 26*a* which determine the insertion position of the stacker to second end portions 25*b* and 26*b* which determine the extracted position of the stacker 152, respectively. In other words, the guide grooves 25 and 26 are formed to be started with horizontal grooves 25*c* and 26*c* which are formed to be substantially horizontal starting from the first end portions 25*a* and 26*a* in a forward direction, passing through first inclination grooves 25*d* and 26*d* which are upward in the inclination at a gentle angle and second inclination grooves 25*e* and 26*e* which are inclination upward in the inclination at an angle slightly more rapid than the first inclination grooves 25*e* and 26*e*, third inclination grooves 25*f* and 26*f* which are inclination upward in the inclination at an angle (for example, like FIG. 4) which is slightly more gentle than the first inclination grooves 25*e* and 26*e* to reach to the second end portions 25*b* and 25*b*.

Into the guide grooves 25 and 26, the guide pins 23 and 24 are inserted, respectively. The guide grooves 25 and 26 are disposed to be discrepant upward and downward in the insertion and extraction direction to pass simultaneously same type grooves, that is, the horizontal grooves 25*c* and 25*c*, the first inclination grooves 25*d* and 26*d*, the second inclination grooves 25*e* and 26*e*, or the third inclination grooves 25*f* and 26*f*. In other words, the guide groove 25 is formed to be vicinity to a rear portion on the side of the guide forming member 27, and the guide groove 26 is formed to exposed on the side of the groove forming member 27 at a position which is lower than the guide groove 25 by a predetermined distance and is located in front of the guide pin 23 with a predetermined distance apart.

A guide gear 22 includes a pinion gear 28 and a lock gear 29 which is engaged with the pinion gear. The pinion gear and the lock gear 29 are disposed on both sides of the second stacker 52, respectively. The pinion gear is combined with the guide pin, so that the pinion gear can rotate around the guide pin with having the guide pin as a shaft. The lock gear 29 is disposed on the guide forming member 27 to engage with an upper edge of the pinion gear 28. In other words, the lock gear 29 is disposed along the upper edge of the guide groove 25.

Figure 10:
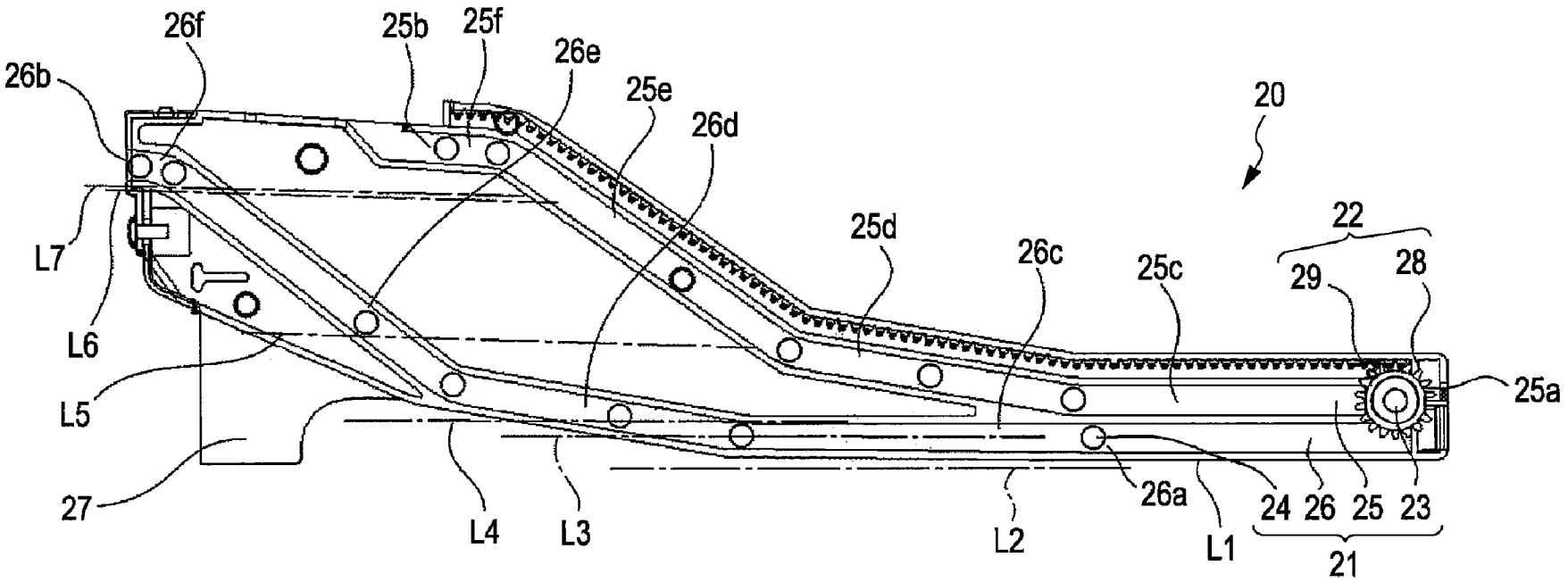
FIG. 10 is a diagram showing positions of a bottom of the stacker, guide pins in guide grooves, and a pinion gear when a stacker is inserted or extracted.

FIG. 10 is a diagram showing positions of a bottom of the stacker, guide pins 23 and 24 in guide grooves 25 and 26, and the pinion gear 28 when the stacker 152 is inserted or extracted. When the guide pins 23 and 24 and the pinion gear 28 are in the first end portions 25*a* and 26*a* of the guide grooves 25 and 26, respectively, which correspond to insertion positions, the bottom position L1 of the stacker 152 is substantially horizontal. This status is maintained while the guide pins 23 and 24 and the pinion gear 28 pass through the horizontal grooves 25*c* and 26*c* of the guide grooves 25 and 26 when the stacker 152 is extracted.

When the guide pins 23 and 24 and the pinion gear 28 reach boundaries between the horizontal grooves 25*c* and 26*c* of the guide grooves 25 and 26 and the first inclination grooves 25*d* and 26*d* after the stacker 152 is extracted more, the bottom position L2 of the stacker 152 is slightly inclination downward in a front inclination, but maintains a substantial horizontality. This status is maintained when the guide pins 23 and 24 and the pinion gear 28 reach boundaries between the first inclination groove 25*d* and 26*d* and the second inclination grooves 25*e* and 26*e* after passing through the first inclination groove 25*d* and 26*d* since the stacker is extracted further more. At this time, the stacker 152 moves upward in the inclination.

When the guide pins 23 and 24 and the pinion gear 28 go into the second inclination grooves 25*e* and 26*e* of the guide grooves 25 and 26 after the stacker 152 is extracted further more, the bottom position L5 of the stacker 152 returns to be substantially horizontal. This status is maintained while the guide pins 23 and 24 and the pinion gear 28 pass the second inclination grooves 25*e* and 26*e* of the guide grooves 25 and 26 after the stacker 152 is extracted further more. At this time, the stacker 152 moves further upward in the inclination.

When the guide pins 23 and 24 and the pinion gear 28 reach boundaries between the second inclination grooves 25*e* and 26*e* of the guide grooves 25 and 26 and the third inclination grooves 25*f* and 26*f* of the guide grooves 25 and 26 after the stacker 152 is extracted further more, the bottom position L6 of the stacker 152 is slightly inclination upward in a front inclination, but maintains a substantial horizontality. This status is maintained when the guide pins 23 and 24 and the pinion gear 28 reach the second end portions 25*b* and 26*b* of the guide grooves 25 and 26. At this time, the stacker 152 moves upward in the inclination and positioned in the extracted position. When the stacker 152 moves from the extracted position to the insertion position, the operations are the same as described above.

Before using the ink jet type printer 100 having the structure described above, the user hangs his finger on an upper portion of the first stacker 51 and rotates the first stacker 51 forward to open the discharge slot 151. And then, the user pulls in a front end of the first stacker 51 with his finger and moves the second stacker 52 parallel upward in the inclination to be protruded. In addition, after using the ink jet type printer 100, the user moves the second stacker 52 parallel downward in the inclination for insertion by pushing a front end of the first stacker 51 with his hand. And then, the user rotates the first stacker 51 backward to block the discharge slot 151 by touching the first stacker 51 with his hand.

According to a stacker 152 having the structure described above, large space below the recording portion 200 and the discharge portion 150 can be acquired to be able to form a stacker 152 having a size appropriate for a relatively large size recording medium without forming a three or more level stacker based on general technology for stable stacking of the recording medium. In addition, when the ink jet type printer 100 is not used, the discharge slot 151 can be blocked to prevent penetration of dusts into a main body of the printer.

In addition, two guide pins 23 and 24 are guided into two different grooves 25 and 26, the stacker is moved between the insertion position and the extracted position without largely changing a substantial set angle of substantial horizontality of the stacker 152, and according the twisting between the guide pins 23 and 24 and the guide grooves 25 and 26 doest not occur to acquire a smooth operation in the insertion and extraction of the stacker 152. In addition, since the stacker 152 is guided by the pinion gear 28 and the rack gear 29, and more over, the gear is combined with the guide pin 23 to guide the guide pin directly, a smoother operation can be acquired in the insertion and extraction of the stacker 152.

As described above, the user hangs his finger on an upper portion of the first stacker 51 and rotates the first stacker 51 forward to open the discharge slot 151 when using the stacker 152. And then, the user pulls in a front end of the first stacker 51 with his finger and moves the first stacker portion 52*a* into which the second stacker portion 52*b* is inserted parallel upward in the inclination to be protruded. And then, the user pulls in an front end of the first stacker 51 with his finger to draw the second stacker portion 52*b* out of the first stacker portion.

In addition, after using the stacker 152, the user pushes the front end of the first stacker with his hand to insert the second stacker portion 52*b* into the first stacker portion 52*a*. And then, the user parallel moves the first stacker portion 52*a* into which the second stacker portion 52*b* is inserted upward in the inclination to be protruded by pushing the front end of the first stacker 51 with his hand. And then, the user rotates the first stacker 51 backward to block the discharge slot 151 by touching the first stacker 51 with his hand. As described above, since the operation order of the first stacker portion 52*a* and the second stacker portion 52*b* needs to be reversed for insertion and extraction, an operation regulation mechanism 30 is formed.

FIGS. 11 to 15 are diagrams showing the operation regulation mechanism 30. The operation regulation mechanism 30 includes a biasing portion (a first operation regulation portion) 31, a rear locking portion (a second operation regulation portion) 32, and a front locking portion (a third operation portion) 33 which are formed in a first stacker portion 52*a* and a protrusion portion (a second and third operation regulation portion) 34 formed in a second stacker portion 52*b* shown in FIG. 14.

Figure 11:
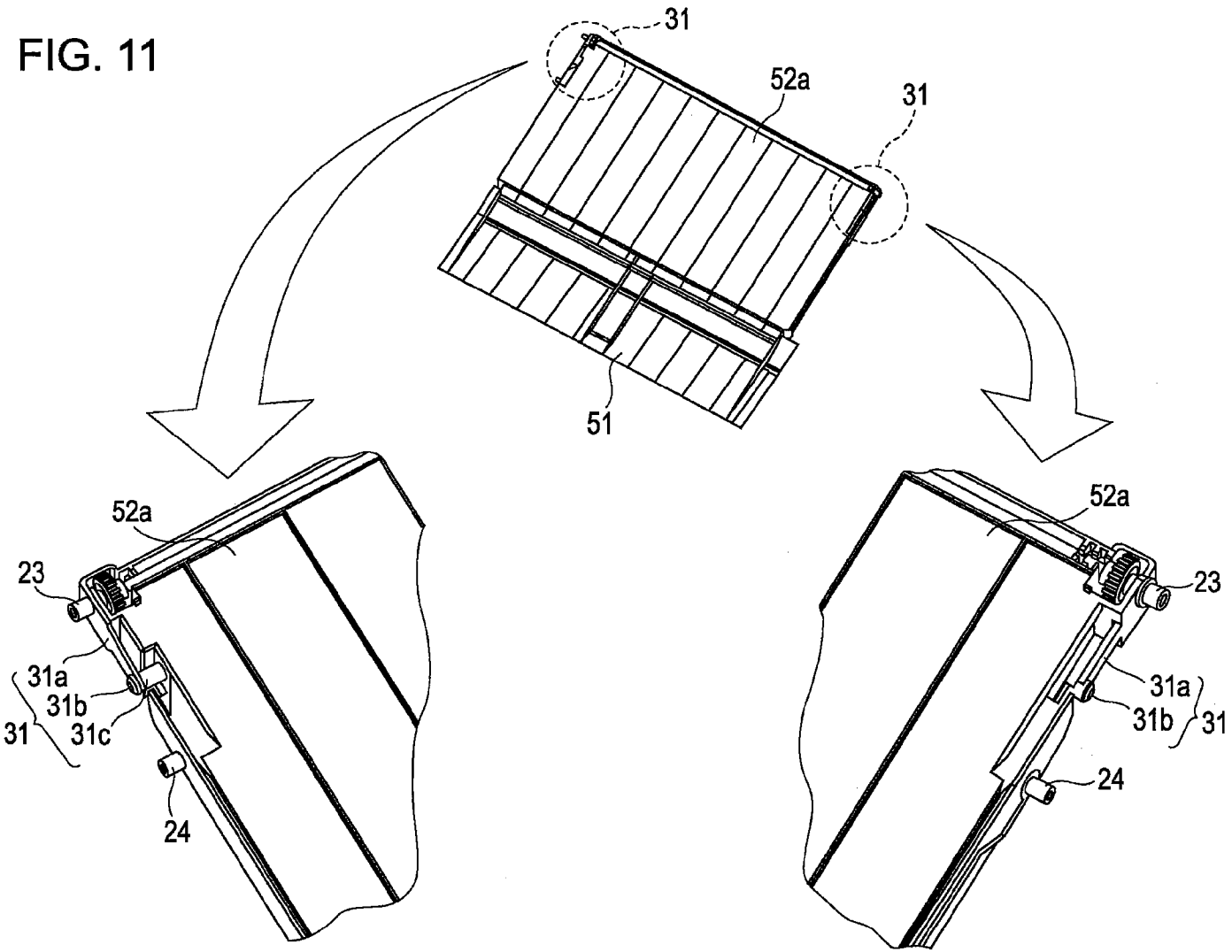
FIG. 11 is a first diagram for describing an operation regulation mechanism in inserting or extracting the stacker of FIG. 6.

The biasing portion 31, as shown in FIG. 11, is formed between two guide pins 23 and 24 which are formed on both sides of the first stacker portion 52*a*. The biasing portion 31 includes a fixed end on a guide pin 23 side and a cantilever type arm 31 of a free end on a guide pin side 24. The fixed end of the biasing portion 31 is combined with a side portion of the first stacker portion 52*a* into one body, and on the free end side, a projecting portion 31*b* which is protruded outside is formed on the free end side. In the left biasing unit 31 shown in FIG. 11, a compression coil spring 31*c* of which one end contacts an inner side portion of the projecting portion and the other end contacts a side portion of the first stacker portion 52*a* is disposed. The compression coil spring 31*c* bends the arm 31 by pressing on an outside of the projecting portion.

Figure 12A:
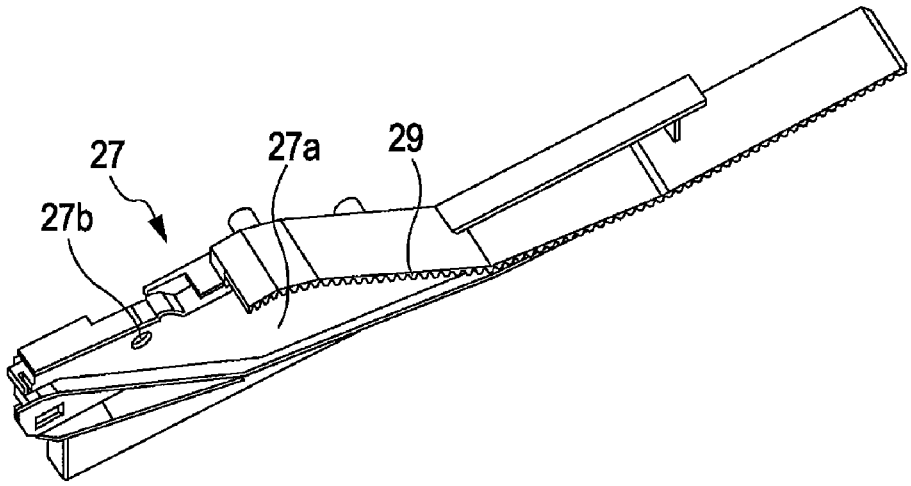
FIG. 12 is a second diagram for describing an operation regulation mechanism in inserting or extracting the stacker of FIG. 6.
Figure 12B:
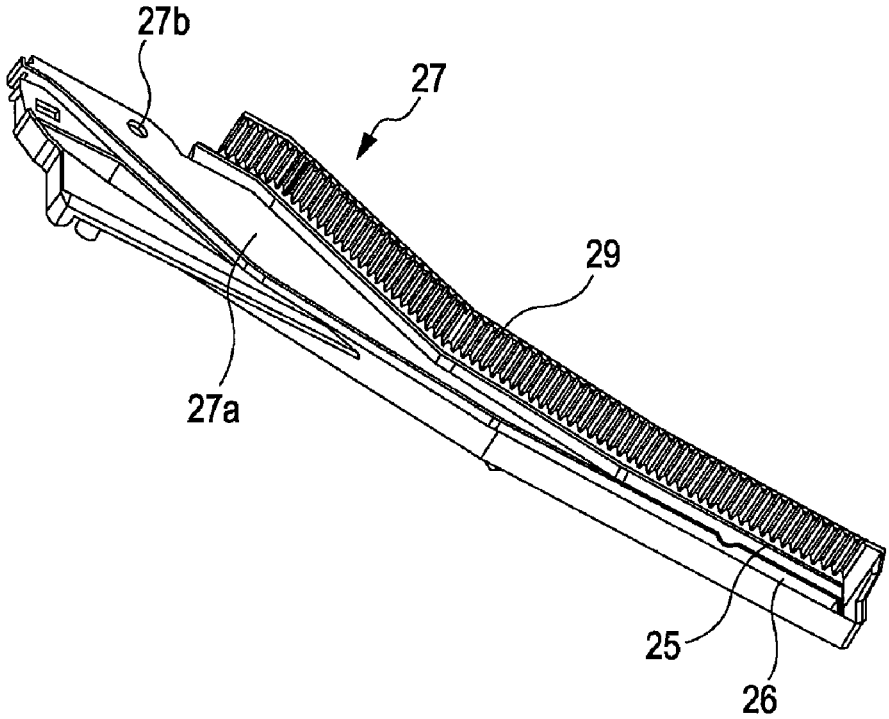

The projecting portion 31*b* of the biasing portion 31 in the structure described above is located at a groove portion 27*a* between two guide grooves of the guide forming member 27 shown in FIGS. 12(A) and 12(B). When the second stacker portion 52*b* is in the insertion status, the first stacker portion 52*a* is parallel moved upward in the inclination to be protruded, and the projecting portion 31*b* is to be inserted into a depressed portion 27*b* formed in the groove portion 27*a* of the guide forming member 27.

Figure 13:
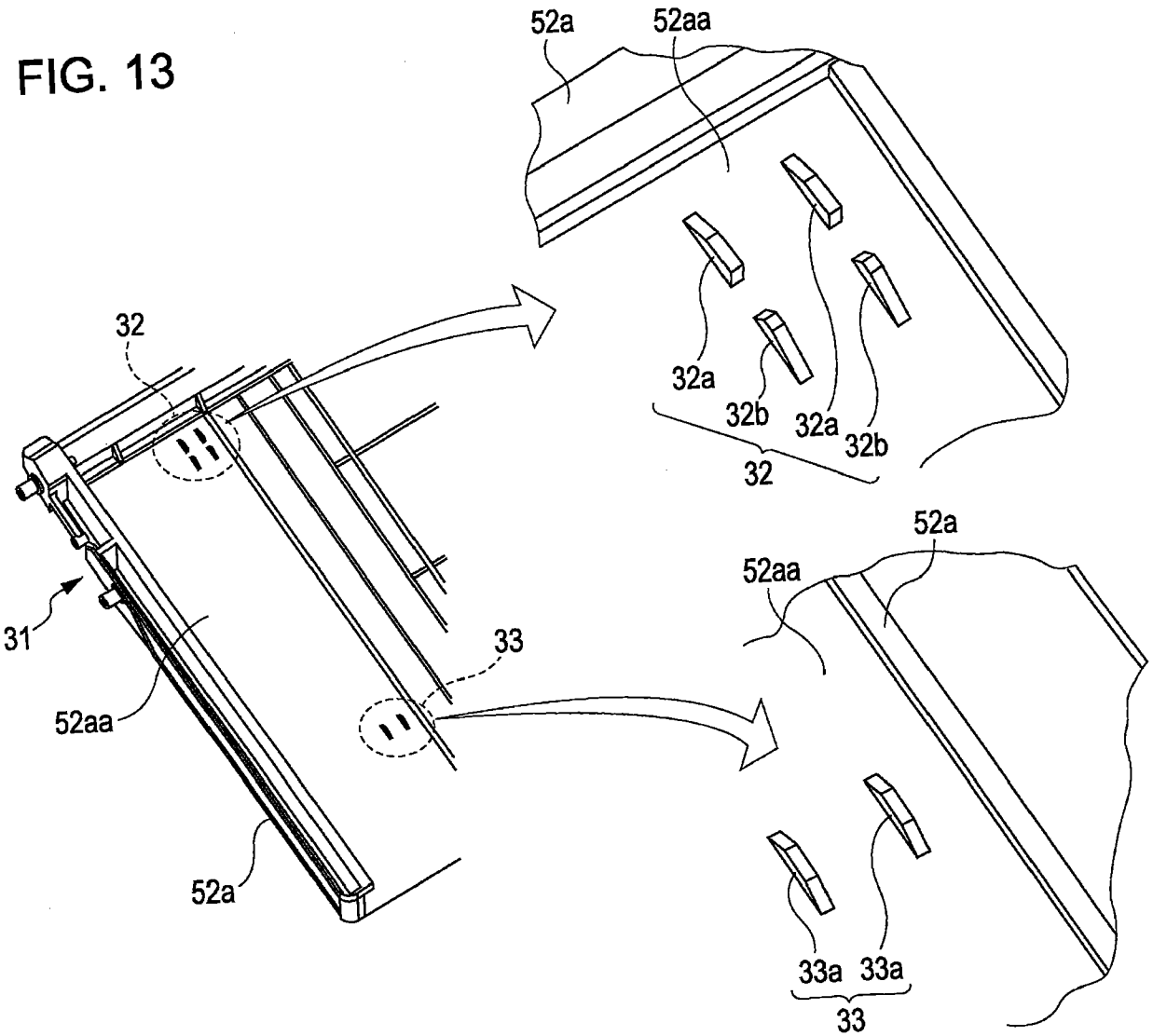
FIG. 13 is a third diagram for describing an operation regulation mechanism in inserting or extracting the stacker of FIG. 6.

As shown in FIG. 13, the rear locking portion 32 and the front locking portion 33 are formed on both sides of a rear portion and both sides of a front portion on a bottom 52*a* of a receiving portion of the second stacker portion 52*b* in the first stacker portion 52*a*, respectively. In FIG. 13, although only the rear locking portion 32 and the front locking portion 33 on one side are shown, however, a structure on the other side is the same. In the rear locking portion 32, two locking protrusions 32*a* and 32*b* having trapezoid pole shapes of which shapes viewed from sides are trapezoids are disposed while being spaced by a predetermined distance in a insertion/extraction direction. In addition, when two locking protrusions 32*a* and 32*b* are collectively regarded as one set, two sets of the locking protrusions are disposed while being spaced by a predetermined distance in a direction perpendicular to the insertion/extraction direction of the second stacker portion 52*b*. In the front locking portion 33, two locking protrusions 33*a* and 33*b* having trapezoid pole shapes of which shapes viewed from sides are trapezoids are disposed while being spaced by a predetermined distance in a insertion/extraction direction of the second stacker portion 52*b*.

Figure 14:
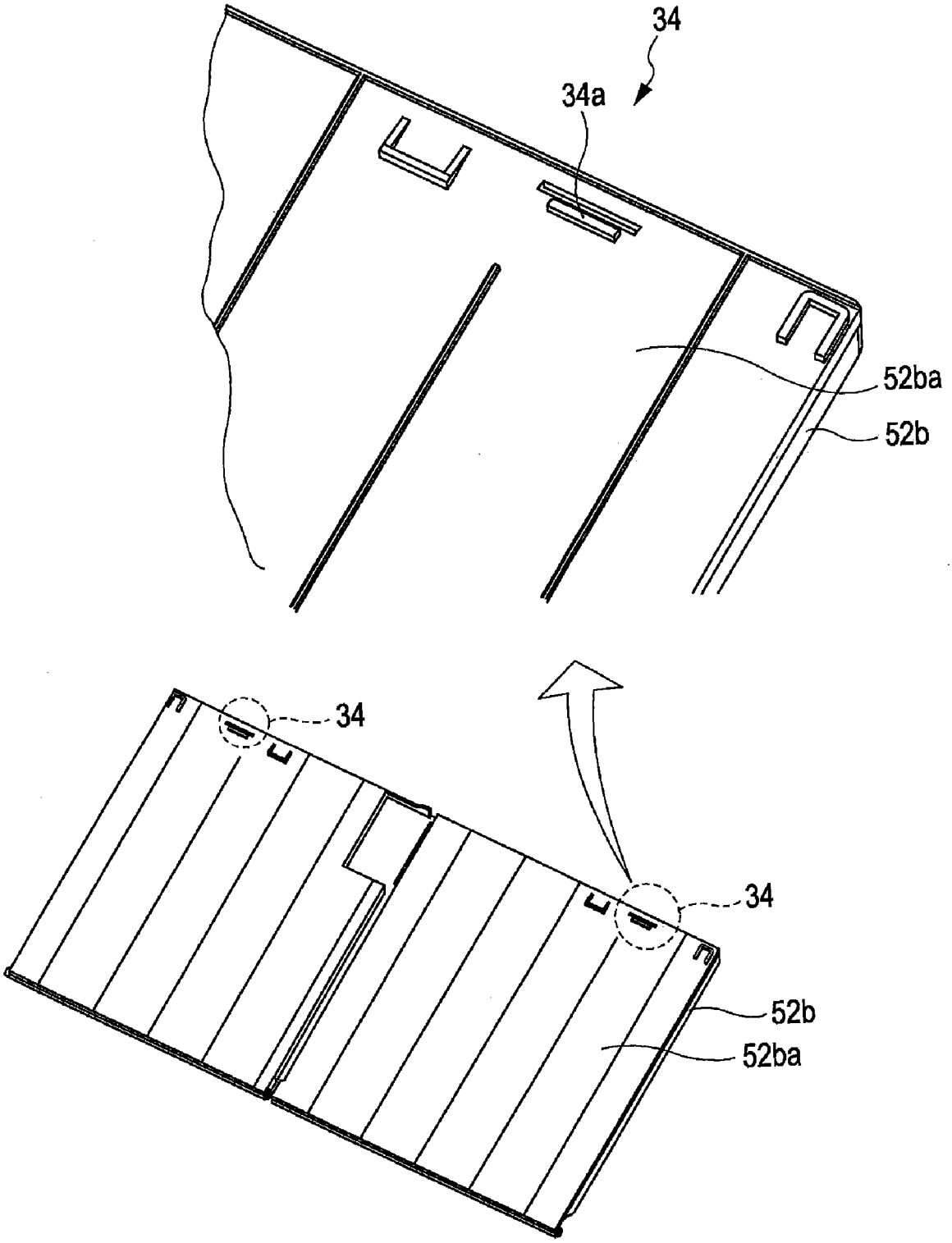
FIG. 14 is a fourth diagram for describing an operation regulation mechanism in inserting or extracting the stacker of FIG. 6.

As shown in FIG. 14, the protrusion portion 34 is formed on a rear portion of both sides on the other side of the second stacker portion 52*b*. The protrusion portion 34 is disposed to be protruded as a protrusion 34*a* to be locked having a shape of a stick which extends in a direction perpendicular to the insertion/extraction direction of the second stacker portion 52*b*. The protrusion 34*a* to be locked constructing the protrusion portion 34 is formed to have a width which is slightly smaller than the disposition space between the two locking protrusions 32*a* and 32*b* constructing the rear locking portion 32 and a little larger than the disposition space between two sets of locking protrusions 32*a*, 32*b* and 32*a* and 32*b*.

Figure 15A:
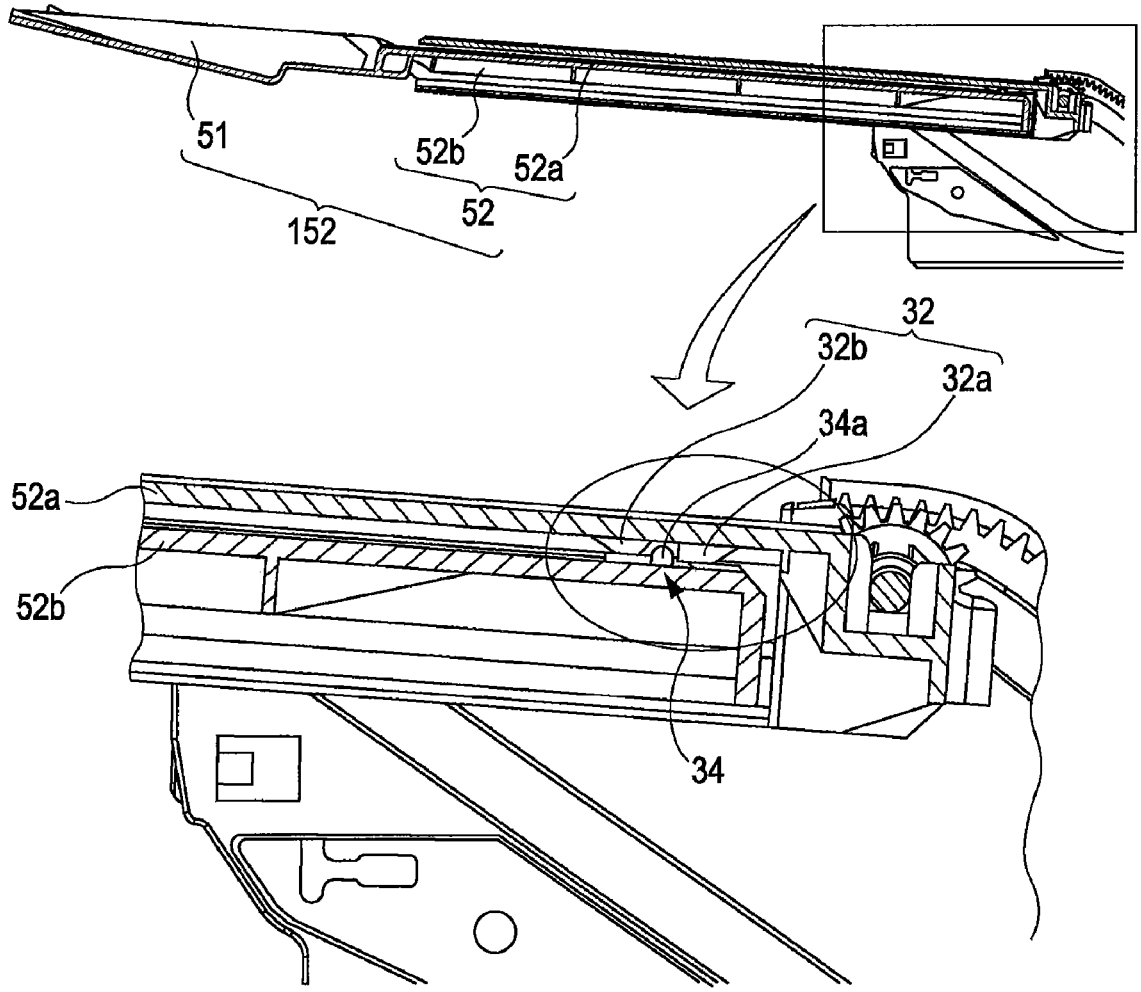
FIG. 15 is a fifth diagram for describing an operation regulation mechanism in inserting or extracting the stacker of FIG. 6.
Figure 15B:
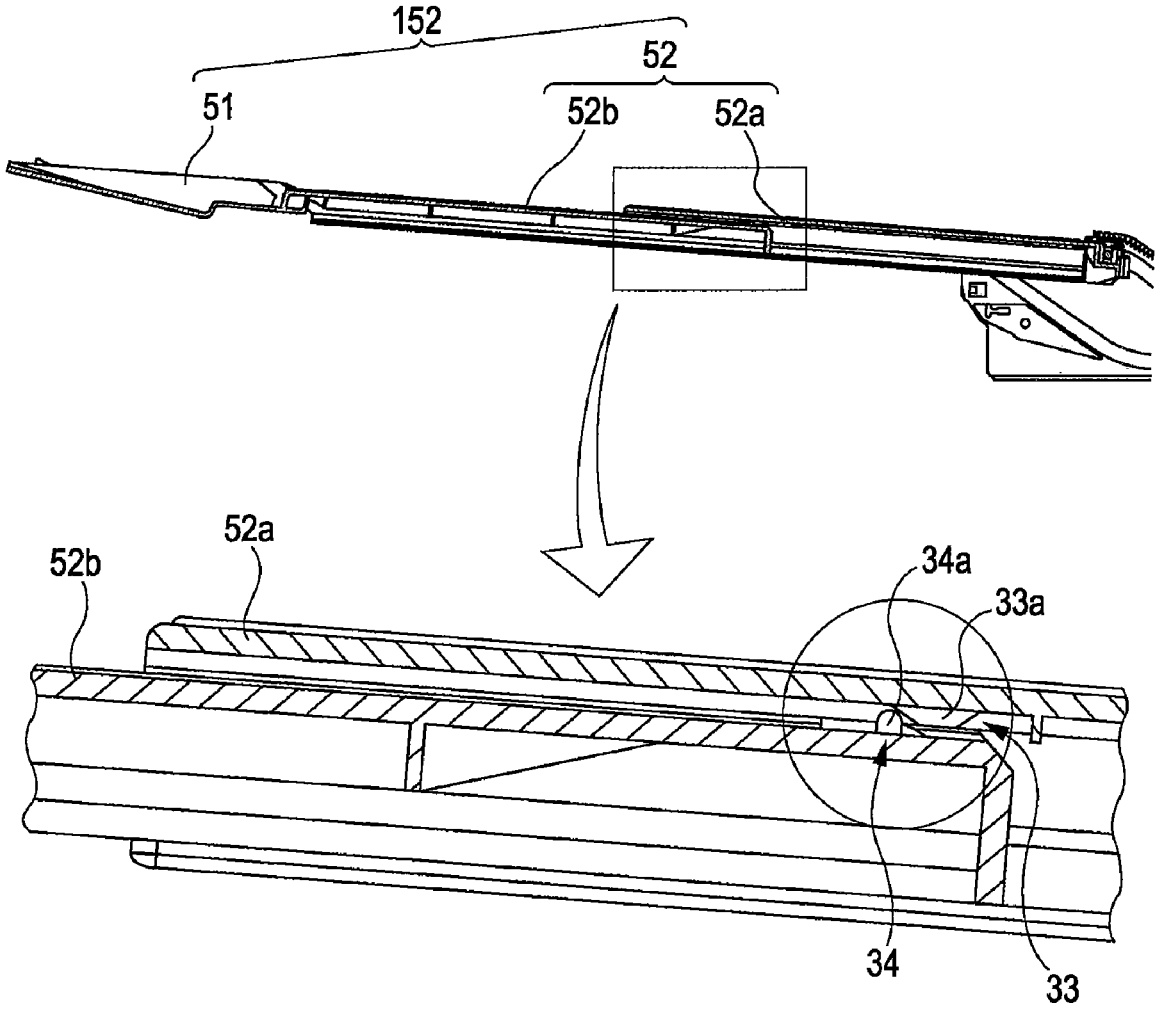

As shown in FIG. 15(A), the protrusion 34*a* to be locked constructing the protrusion portion 34 in the structure described above is to be locked by being inserted between two locking protrusions 32*a* and 32*b* construction the rear locking portion 32 in a status that the first stacker portion 52*a* into which the second stacker portion 52*b* is inserted is parallel moved upward in the inclination to be protruded. As shown in FIG. 15(B), the protrusion 34*a* to be locked constructing the protrusion portion 34 is to be locked by passing two locking protrusions 32*a* and 32*a* to the front side in a status that the second stacker portion 52*b* is extracted to be protruded from the first stacker portion 52*a*.

In using the stacker 152 of the structure described above, for pulling in the first stacker portion 52*a* into which the second stacker portion 52 is inserted instead of pulling the second stacker portion 52*b* out of the first stacker portion 52*a* when the user pulls a front end of the first stacker 51 with his finger, the following condition is required. That is, a friction force (resistance force) applied between the projecting portion 31*b* of the biasing portion 31 and the groove portion 27*a* of the guide forming member 27*a* should be smaller than a resultant force (resistance force) applied between the protrusion 34*a* to be locked constructing the protrusion portion 34 and the locking protrusion 32*b* constructing the rear locking portion 32. Under this condition, the first stacker portion 52*a* into which the second stacker portion 52*b* is inserted can be parallel moved upward the inclination to be protruded. In addition, the second stacker portion 52*b* can be extracted from the first stacker portion 52*a* to be protruded.

In addition, when the user pushes the front end of the first stacker 51 with his hand after using the stacker 152, only the second stacker portion 52*b* is to be inserted into the first stacker portion 52*a* rather than the first stacker portion 52*a* from which the second stacker portion is extracted is inserted. To achieve this, the following condition is required. That is, a retaining force applied when the projecting portion 31*b* of the biasing portion 31 is combined with the depressed portion 27*b* of the guide forming member 27 should be made be larger than a resultant force applied between the protrusion 34*a* to be locked constructing the protrusion portion and the locking protrusion 33*a* constructing the front locking portion 33. Under this condition, the second stacker portion 52*b* can be inserted into the first stacker portion 52*a*. In addition, the first stacker portion 52*a* into which the second stacker portion 52*b* is inserted can be parallel moved downward in the inclination to be inserted by pushing the front end of the first stacker 51. As described above, switching between the insertion/extraction can be performed by one action, the operation ability can be improved.

The retaining force applied when the projecting portion 31*b* of the biasing portion 31 is combined with the depressed portion 27*b* of the guide forming member 27 can be easily set or changed by managing a spring constant of the compression coil spring 31*c*, a combination depth of the projecting portion 31*b*, or a rake angle of edges of the depressed portion 27*b*. In addition, a resultant force (resistance force) applied between the protrusion 34*a* to be locked constructing the protrusion portion 34 and the locking protrusion 32*b* constructing the rear locking portion 32 and a resultant force (resistance force) applied between the protrusion 34*a* to be locked constructing the protrusion portion 34 and the locking protrusion 33*a* constructing the front locking portion 33 can be easily set and changed by managing tilt angles of slopes of the locking protrusions or heights of locking protrusions 32*b* and 33*a* and protrusions to be locked 34*a*. Alternatively, a depressed portion into which the locking protrusions 32*b* and 33*a* can be combined may be formed instead of the protrusion 34*a* to be locked, or a depressed portion into which the protrusions 34*a* to be locked 2*b* can be combined may be formed instead of the locking protrusions 32*b* and 33*a*.

Although an ink jet type printer as a recording device is described as an exemplary embodiment, however, the invention may be applied to any recording device including a facsimile device and a copy machine. In addition, the invention can be applied to a liquid ejecting apparatus which attaches liquids by ejecting liquids appropriate for the use from a liquid ejecting head onto a liquid-ejecting medium including a color ejecting head which is used for manufacturing a color filter for a liquid crystal display or the like, an electrode material ejecting (conduction paste) head which is used for forming an electrode including an organic EL display or a FED, a vital organic matter ejecting head, a sample ejecting head as a precision pipet, and the like.

What is claimed is:

1. A media stacker which can be inserted into a main body of a liquid ejecting apparatus and stack a discharged recording medium, the media stacker comprising:

a guide mechanism formed on both sides of the media stacker which is capable of guiding the movement of the media stacker between a first position located in front of a discharge portion where the media stacker is capable of receiving a discharged recording medium which has been recorded by a liquid ejecting portion and ejected from the discharge portion of the liquid ejecting apparatus in a horizontal direction and a second position located downward and in an inclined direction from the first position, so as to be located below the liquid ejecting portion and discharge portion;

a guide gear which rotates while following the guide mechanism which is also formed on both sides of the media stacker;

a first stacker portion in which the guide mechanisms are formed;

a second stacker portion which can be inserted into or extracted from the first stacker portion; and an operation regulation mechanism which regulates operations, so that the second stacker portion is not extracted when the first stacker portion is being extracted and the first stacker portion is not inserted when the second stacker portion is being inserted;

wherein the media stacker moves downward in an inclined direction to be located below a liquid ejecting portion and a discharge portion at the second position when the media stacker is being inserted and the media stacker moves upward in the inclined direction to be located at the first position in front of the discharge portion of the liquid ejecting apparatus when the media stacker is being extracted.

2. The media stacker according to claim 1, wherein the guide mechanism includes a guide pin which is formed in a main body of the media stacker and a guide groove which is formed on the main body of the liquid ejecting apparatus and extends in insertion/extraction directions and inclined upward/downward directions, and wherein the guide gear includes a pinion gear which is formed on the main body of the media stacker and a rack gear which is formed on the main body of the liquid ejecting apparatus which extends in the insertion/extraction directions and the inclined upward/downward directions, wherein the pinion gear is driven by a user applying a force on the media stacker so as to move the media stacker between the first and second position.

3. The media stacker according to claim 2, wherein the guide mechanisms formed on both sides of the media stacker are disposed to be displaced from each other in the insertion/extraction direction and in the upward/downward directions.

4. The media stacker according to claim 1, wherein the operation regulation mechanism includes a first regulation mechanism for regulating an operation of insertion of the first stacker portion in an extracted state, a second regulation mechanism for regulating an operation of extracting the second stacker portion in an inserted state, and a third regulation mechanism for regulating an operation of insertion of the second stacker portion in an extracted state.

5. The media stacker according to claim 4, wherein the first operation regulation portion includes a recessed portion which is formed on a main body of the liquid ejecting apparatus and a projecting portion which is formed in a rear side of the first stacker portion and can be inserted into the recessed portion, wherein the second operation regulation portion includes a first locking protrusion which is formed in the rear side of the first stacker portion and a protrusion to be locked which can be locked by the first locking protrusion, and wherein the third operation regulation portion includes a second locking protrusion which is formed in a front side of the first stacker portion and can lock the protrusion to be locked.

6. A liquid ejecting apparatus for ejecting liquids onto a medium, comprising: the media stacker according to claim 1.

7. A recording device for recording information on a recording medium, comprising: the liquid ejecting apparatus according to claim 6.

* * * * *

UNITED STATES PATENT AND TRADEMARK OFFICE

CERTIFICATE OF CORRECTION

PATENT NO. : 7,584,959 B2
APPLICATION NO. : 11/561831
DATED : September 8, 2009
INVENTOR(S) : Masaaki Kinoshita It is certified that error appears in the above-identified patent and that said Letters Patent is hereby corrected as shown below:

ON THE FACE PAGE:

1. On the Face Page, in Field (75), Column 1, Line 1, delete "Masaaski" and insert -- Masaaki --, therefor.

Signed and Sealed this

Third Day of November, 2009

David J. Kappos

David J. Kappos
*Director of the United States Patent and Trademark Office*